US006241540B1

(12) United States Patent
Tokuwa

(10) Patent No.: US 6,241,540 B1
(45) Date of Patent: Jun. 5, 2001

(54) CONNECTOR WITH LOCKING LEVER

(75) Inventor: Koichiro Tokuwa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/312,787

(22) Filed: May 17, 1999

(30) Foreign Application Priority Data

May 21, 1998 (JP) ..... 10-139658

(51) Int. Cl.[7] ..... H01R 13/62
(52) U.S. Cl. ..... 439/157; 439/372
(58) Field of Search ..... 439/157, 153, 439/372

(56) References Cited

U.S. PATENT DOCUMENTS

| | | | | |
|---|---|---|---|---|
| 5,609,494 | | 3/1997 | Yamaguchi et al. | 439/157 |
| 5,637,003 | | 6/1997 | Takahashi | 439/157 |
| 5,928,010 | * | 7/1999 | Katsuma et al. | 439/157 |
| 5,997,321 | * | 12/1999 | Nakata et al. | 439/157 |

FOREIGN PATENT DOCUMENTS

| | | |
|---|---|---|
| 0 599 332 | 6/1994 | (EP) . |
| 0 736 935 | 10/1996 | (EP) . |
| 0 812 038 | 12/1997 | (EP) . |
| 0 823 757 | 2/1998 | (EP) . |
| 6-45275 | 6/1994 | (JP) . |

* cited by examiner

*Primary Examiner*—Brian Sircus
*Assistant Examiner*—Michael C. Zarroli
(74) *Attorney, Agent, or Firm*—Anthony J. Casella; Gerald E. Hespos; Michael J. Porco

(57) ABSTRACT

A lever type connector is provided to prevent a lever from being inadvertently released. The lever type connector 1 is provided with a connector housing 8 and a lever 7 rotatably assembled with the connector housing 8. A locking portion 18 projects on the upper surface of the connector housing 8, and a lock claw 26 is provided in a recess 31 formed in the lever 7. When the lever 7 is rotated in such a direction as to cover the upper surface of the connector housing 8, the lock claw 26 and the locking portion 18 are engaged, thereby preventing any further rotation of the lever 7. At this time, an error disengagement restricting portion 28 projecting backward of the connector housing 8 prevents the lock claw 26 and the locking portion 18 from being inadvertently disengaged from each other.

8 Claims, 13 Drawing Sheets

CONNECTOR WITH LOCKING LEVER

BACKGROUND OF THE INVENTION

1. Field of the Invention

The present invention relates to a lever type connector.

2. Description of the Related Art

A prior art lever type connector is disclosed in Japanese Unexamined Utility Model Publication No. 6-45275, and is identified generally by the numeral 100 in FIGS. 13 and 14. The connector 100 is provided with a U-shaped lever 102 rotatably assembled therewith. A middle portion of the U-shaped lever 102 is formed with a lock claw 105 that is engageable with a locking portion 104 on the top of a mating connector 103.

The lever type connector 100 is connected with the mating connector 103 by rotating the lever 102 to a position where it covers an upper part of the mating connector 103. Thus, the lock claw 105 and the locking portion 104 are engaged to hold the lever 102 in a locking position (see FIG. 14).

To disengage the lock claw 105 and the locking portion 104, an unlocking portion 106 that extends in a direction substantially opposite from the locking portion 104 is pressed to rotate the lever 102 in a direction opposite from the engaging direction while elastically deforming the locking portion 104 upwardly.

With the lock claw 105 and the locking portion 104 engaged, the unlocking portion 106 is exposed. Thus, if an external force acts on the unlocking portion 106, there is an undesirable likelihood that the locking portion 104 and the lock claw 105 will be disengaged unintentionally.

In view of the above problem, an object of the present invention is to provide a lever type connector in which the engagement by a lever is not inadvertently disengaged.

SUMMARY OF THE INVENTION

A lever type connector according to the invention, comprises a connector housing, and a preferably substantially U-shaped lever rotatably or pivotably mounted on the connector housing. The lever is provided with at least one lock claw which is elastically engageable with at least one corresponding locking portion provided on the connector housing. The lever also has an unlocking portion for disengaging the lock claw from the locking portion. An error disengagement restricting portion is provided in proximity to a surface of the unlocking portion where unlocking is effected when the lock claw and the locking portion are engaged with each other to narrow a space necessary to effect unlocking.

Accordingly, even if an external force acts on the lever type connector, the error disengagement restricting portion makes it difficult for this external force to directly act on the unlocking portion. Thus, an inadvertent disengagement of the lever and the locking portion can be restricted.

According to a preferred embodiment, the connector housing comprises a wire protection cover for protecting wires extending through the rear surface of the connector housing. The wire protection cover also acts as the error disengagement restricting portion. Consequently, since the wire protection cover acts also as the error disengagement restricting portion, it is not necessary to provide a separate error disengagement restricting portion.

Preferably, the lock claw is arranged in a recess and a connection piece is formed above the lock claw for connecting opening edges of the recess. The recess and the connection piece preferably are provided substantially in a middle portion of the lever. The connection piece is formed to restrict an excessive deformation of the lock claw in an unlocking direction. Accordingly, since the lever is strengthened by the connection piece and an excessive deformation of the lock claw is restricted by the connection piece, it is not necessary to separately provide two separate members having such functions.

Still further preferably, the leading end of the unlocking portion is curved to extend along a curved configuration of the outer surface of the wire protection cover while leaving a minimum necessary interval or space therebetween to effect unlocking when the lock claw and the locking portion are engaged with each other. Accordingly, since the leading end of the unlocking portion is curved to extend along the curved configuration of the outer surface of the wire protection cover, an error disengagement restricting function is further enhanced.

Most preferably, the locking portion is provided on the wire protection cover. Accordingly, the locking of the lever can be performed securely, since the interaction between locking portion and lever is performed preferably at a distal portion of the lever. Preferably, two locking portions are provided on opposite sides of the wire protection cover. Then, it is easily possible to safely connect the wire protection cover with a connector housing in a second position in which the cover and the housing are turned by 180° around their common longitudinal axis.

According to a further preferred embodiment, the connector housing is provided with one or more locking portion protection portions preferably at its rear portion for protecting a front part of the locking portion. As a result, an external force is prevented from acting directly on the locking portion from the front. Therefore, an undesirable event where the lock claw and the locking portion are inadvertently disengaged can be avoided more securely.

Preferably, the one or more locking portion protection portions are disposed in front of the locking portion and have a greater vertical dimension than the locking portion.

Further preferably, the lever is mounted rotatably or pivotably on the connector housing by means of one or more lever mount portions. The lever mount portions preferably comprise stopper portions for stopping a rotation of the lever in a predetermined or predeterminable position.

Most preferably, cam elements are provided on the lever for the interaction of mating cam elements provided on the mating connector for forcibly mating the connectors upon rotating or pivoting the lever.

These and other objects, features and advantages of the present invention will become more apparent upon a reading of the following detailed description and accompanying drawings.

DETAILED DESCRIPTION OF THE PREFERRED EMBODIMENT

Figure 1:
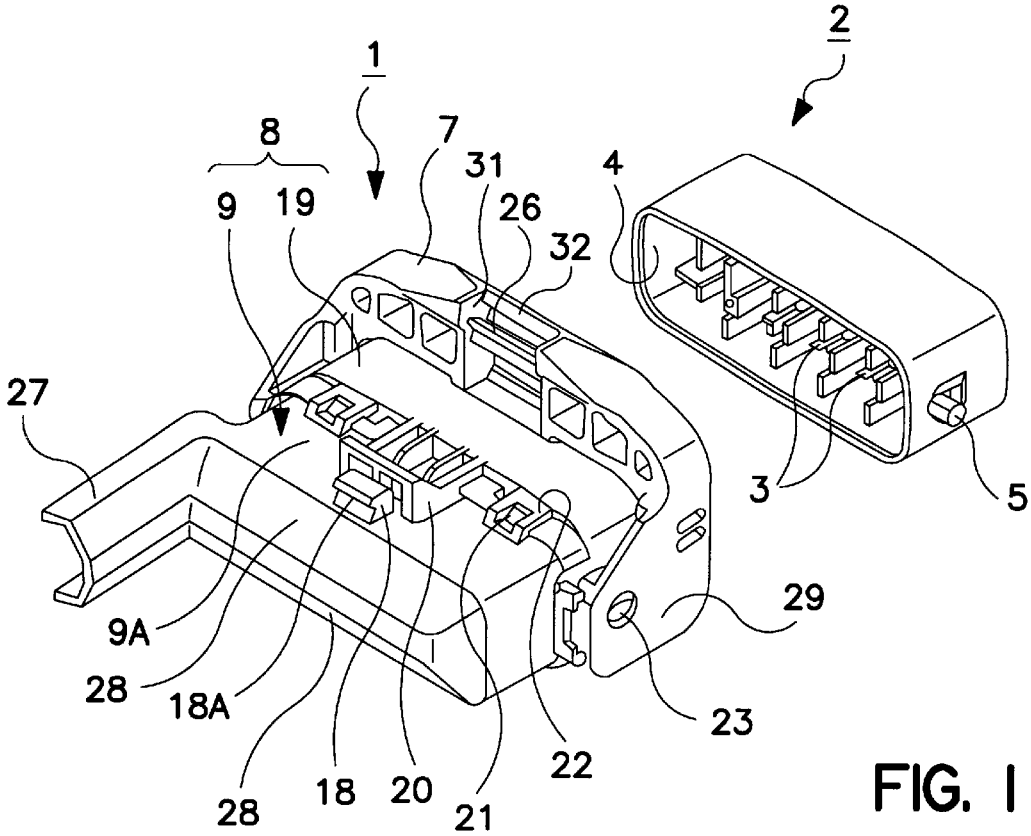
FIG. 1 is a perspective view of a lever type connector according to one embodiment and a mating connector before being connected with each other.

FIG. 1 shows a lever type connector 1 and a mating connector 2 prior to their connection. In the following description, sides of both connectors 1, 2 to be connected with each other are referred to as front sides.

Figure 2:
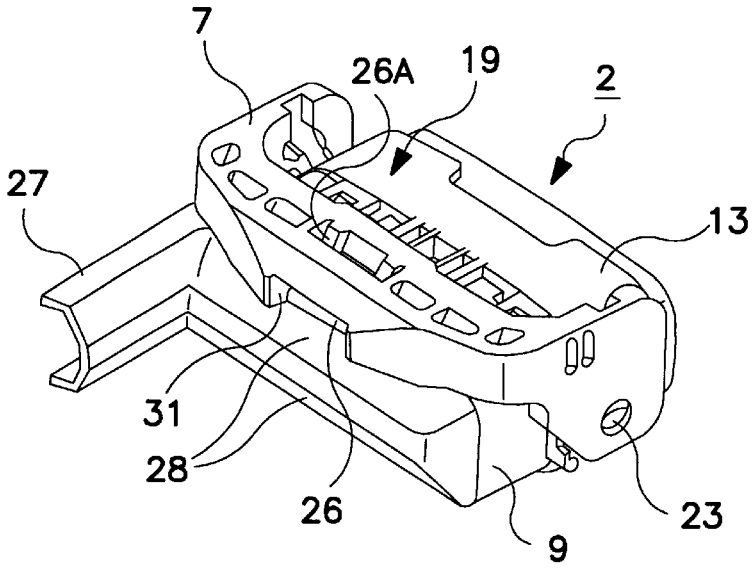
FIG. 2 is a perspective view of the lever type connector and the mating connector after being connected with each other.
Figure 7:
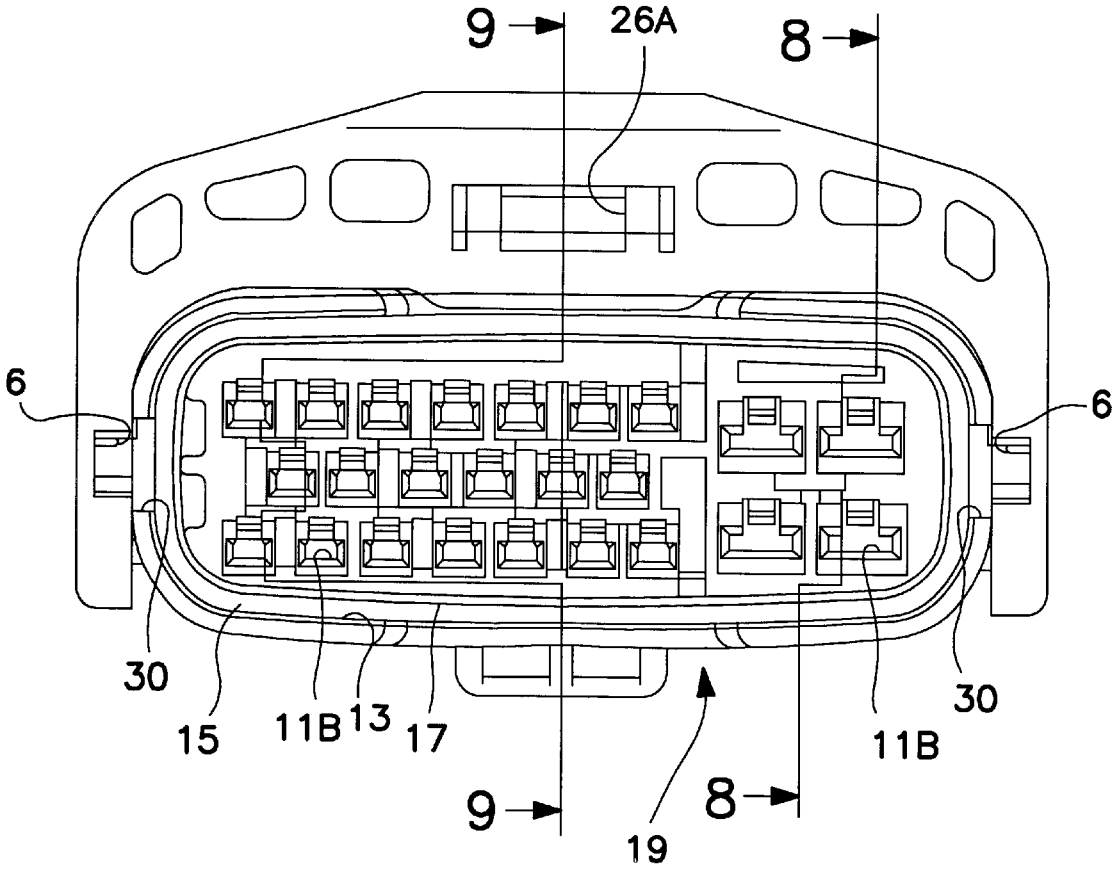
FIG. 7 is a front view of the lever type connector.
Figure 10:
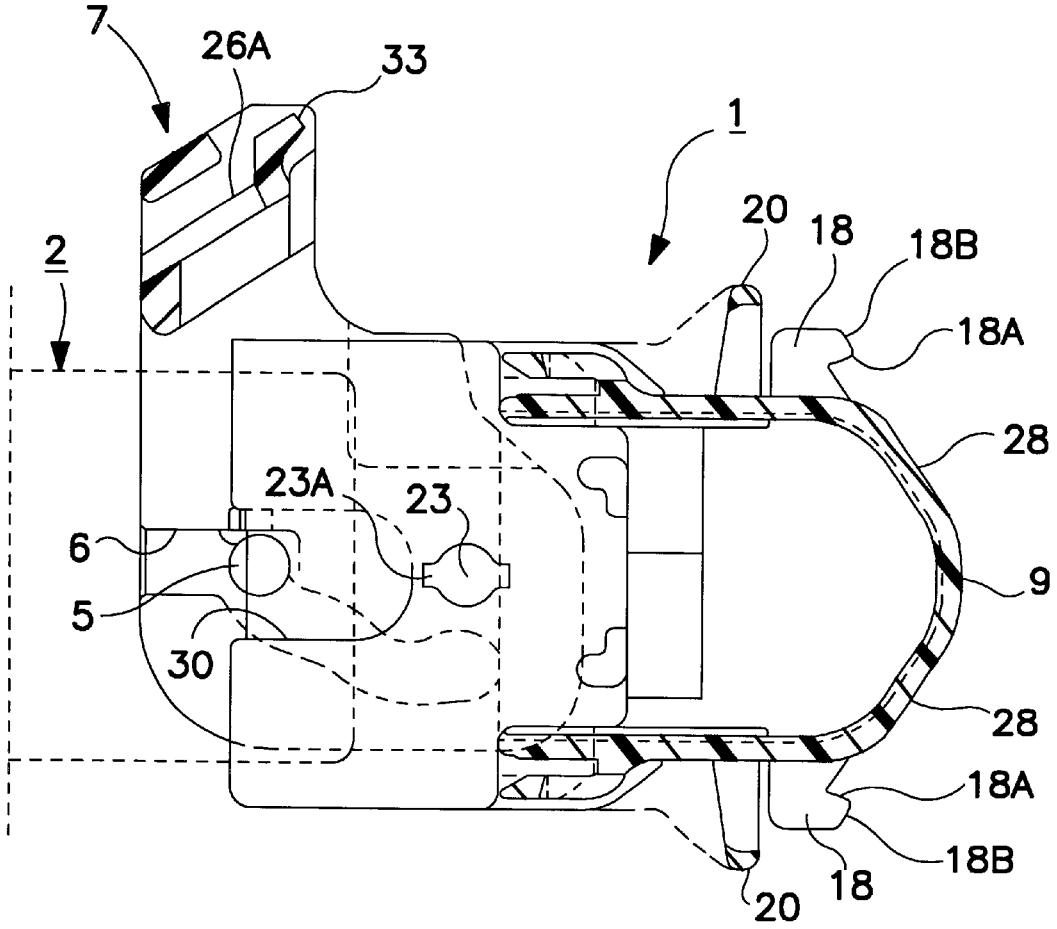
FIG. 10 is a side view of the engaged lever type connector and mating connector before a lever is rotated.

Male terminal fittings 3 are accommodated in the mating connector 2 and are covered substantially by a receptacle 4. A pair of cam pins 5 project at the opposite sides of the mating connector 2. As shown in FIGS. 7 and 10 the cam pins 5 are fitted into cam grooves 6 formed in a lever 7 of the lever type connector 1, preferably when the connectors 1, 2 are connected with each other. As shown in FIG. 2, the mating connector 2 is pulled substantially into the lever type connector 1 as the lever 7 is rotated, thereby completing connection.

The lever type connector 1 is made e.g. of a synthetic resin, and is provided with a connector housing 8 and the lever 7 rotatably or pivotably assembled with the connector housing 8. The connector housing 8 is comprised of a housing main body 19, and a wire protection cover 9 for substantially covering a rear part of the housing main body 19.

Figure 3:
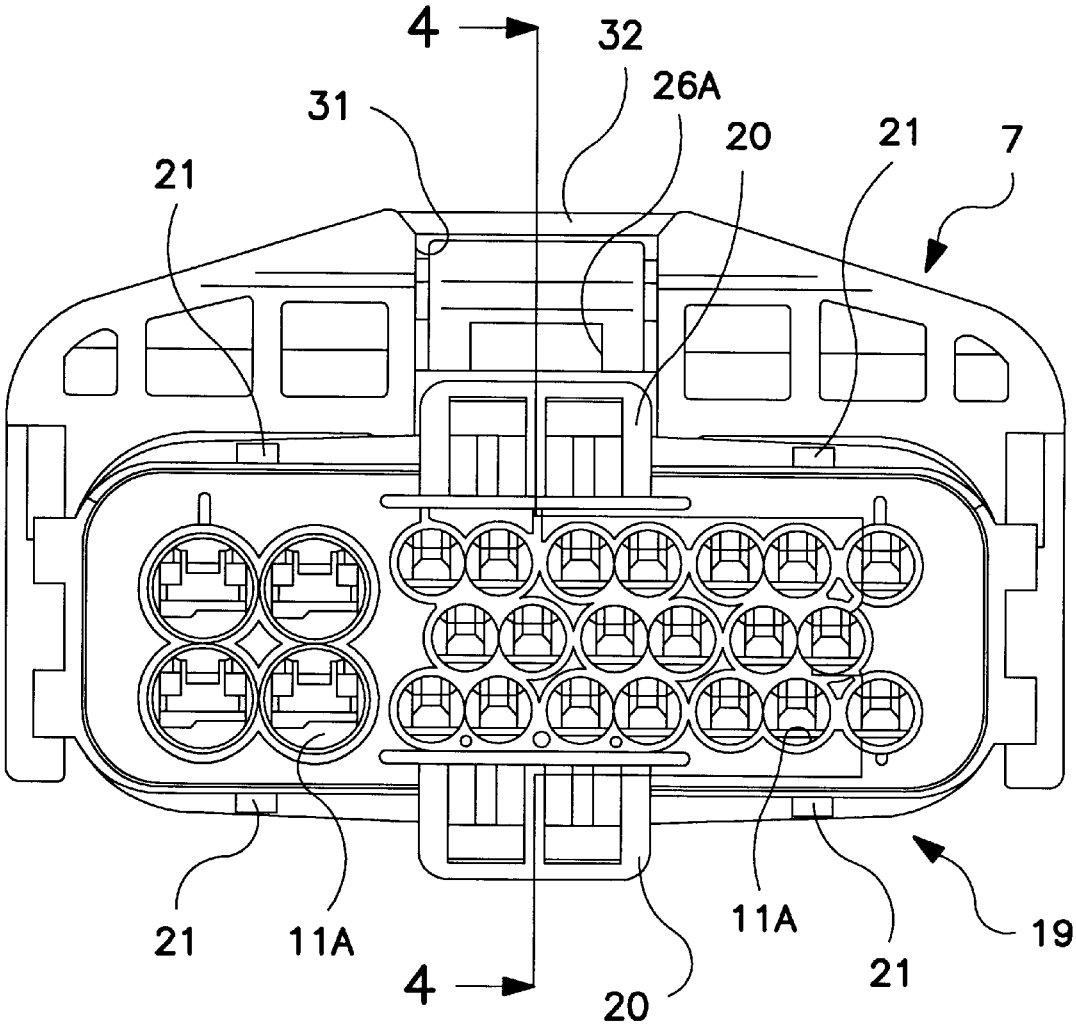
FIG. 3 is a rear view of a housing main body before a wire protection cover is mounted.
Figure 4:
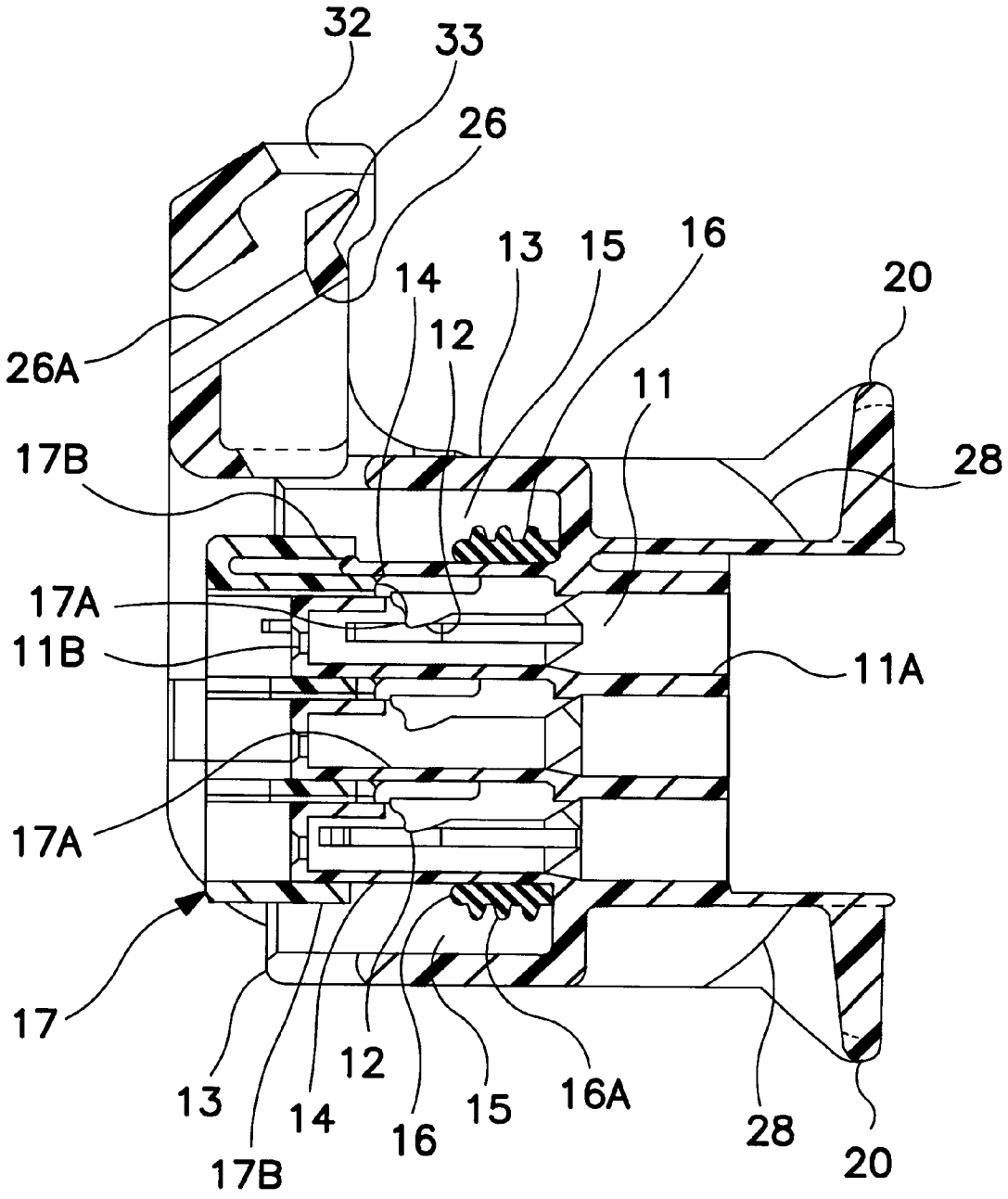
FIG. 4 is a section along A—A of FIG. 3.
Figure 8:
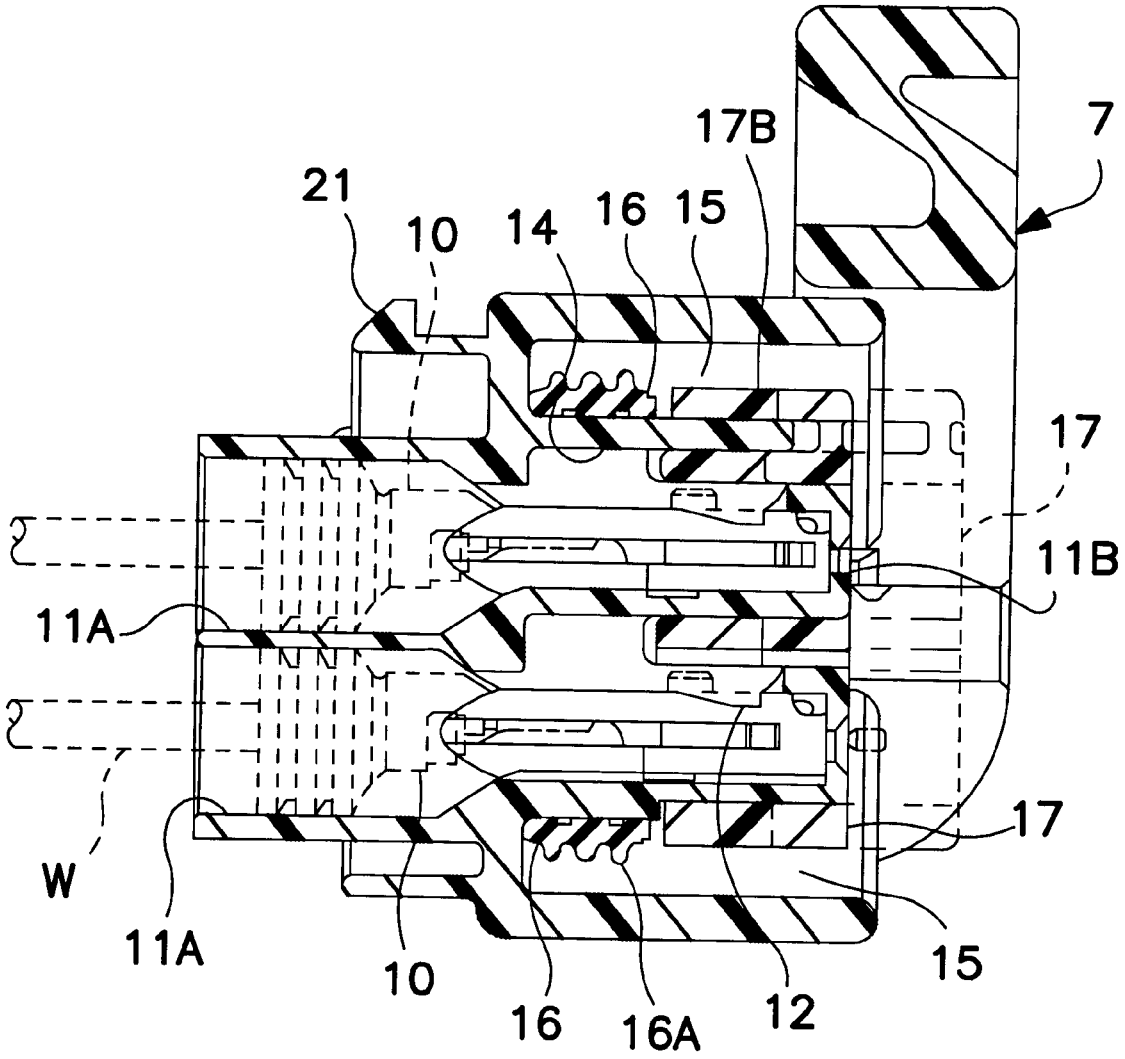
FIG. 8 is a section along B—B of FIG. 7.
Figure 9:
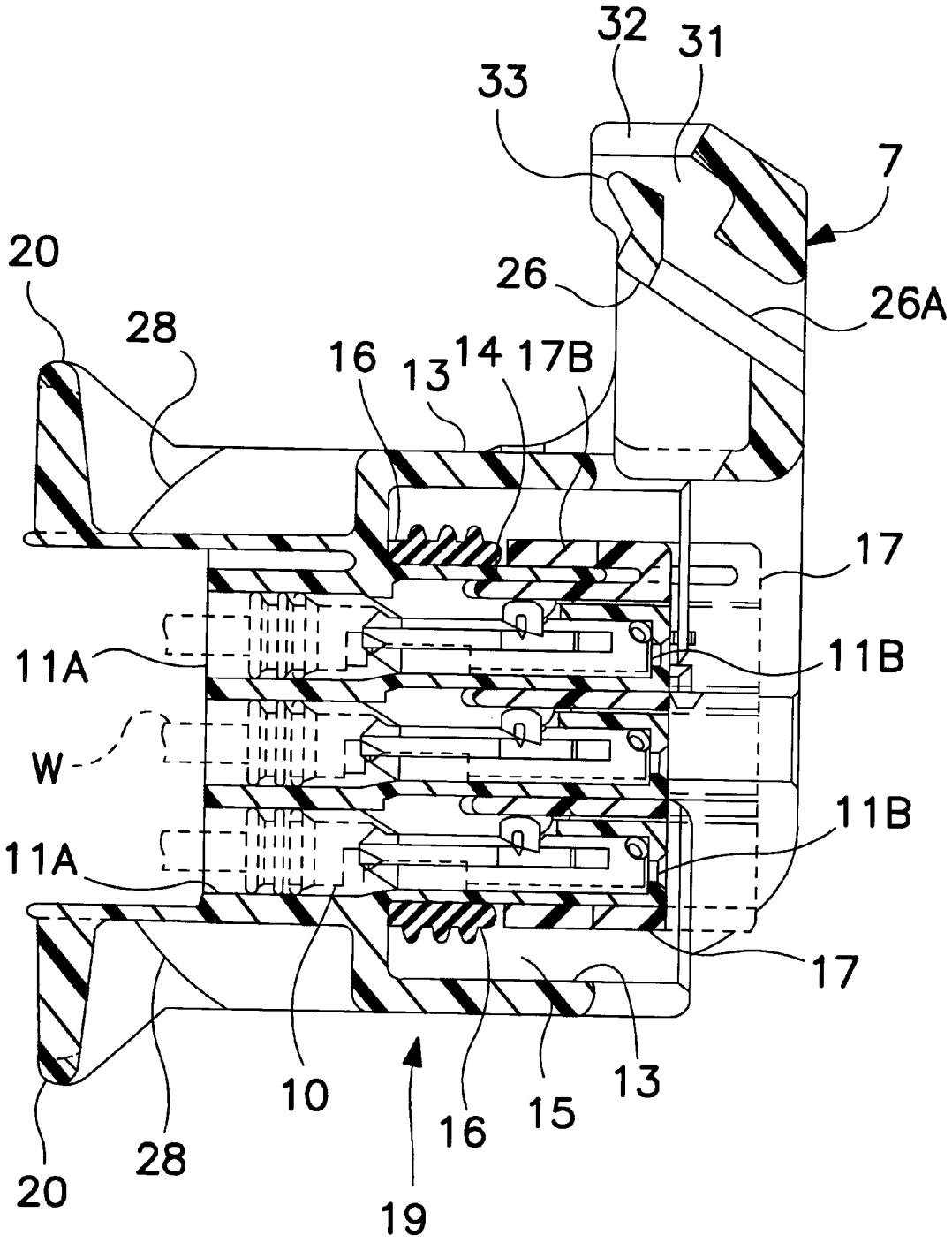
FIG. 9 is a section along C—C of FIG. 7.

As shown in FIG. 3 or 4, the housing main body 19 is formed with cavities 11 for accommodating female terminal fittings 10 (see FIGS. 8 and 9). Two or more kinds of cavities 11 preferably are formed to suit the size of the female terminal fittings 10 that will be accommodated therein. The cavities 11 are open at their front and rear ends. The rear ends of the cavities 11 preferably are widened to serve as terminal insertion openings 11A where the accommodation of the female terminal fittings 10 is started. The front ends of the cavities 11 preferably are narrowed to serve as terminal connection openings 11B through which the male terminal fittings 3 are inserted. A locking portion 12 is provided substantially in the middle of each cavity 11. Each locking portion 12 is elastically engageable with the corresponding female terminal fitting 10.

The female terminal fittings 10 are accommodated or accommodatable in the cavities 11, and are formed by bending conductive members. The female terminal fittings 10 have a substantially box-shaped leading end into which the male terminal fitting 3 is insertable.

A skirt portion 13 projects at a front part of the housing main body 19. The skirt portion 13 is dimensioned to receive the receptacle 4 of the mating connector 2.

A waterproof member 16 (FIG. 4) is fitted substantially entirely on the back of a wall portion 14. This waterproof member 16 is made e.g. of a synthetic rubber, and preferably three circumferentially extending projections 16A are formed on the outer surface thereof. The projections 16A are deformed compressively by the receptacle 4 of the mating connector 2 to hold connected portions of the connectors 1, 2 watertight.

Further, a retainer 17 is mounted or mountable preferably from the front of the wall portion 14. The retainer 17 has a slightly smaller outer diameter than the skirt portion 13 and is formed with an opening in a position substantially conforming to the positions of terminal connection openings 11B of the respective cavities 11. The retainer 17 is formed with deformation restricting portions 17A in positions corresponding to where the engaging portions 12 are elastically deformed when being brought into engagement with the female terminal fittings 10. When the retainer 17 is assembled with the housing main body 19, the deformation restricting portions 17A are pressed into a portion between the engaging portions 12 and the wall portion 14, thereby preventing the engaging portions 12 from being elastically deformed or deflected.

An outer wall 17B of the retainer 17 engages the wall portion 14 in a position slightly forward from the leading edge of the waterproof member 16 (see FIGS. 8 and 9). Thus, the retainer 17 also has a function of preventing the waterproof member 16 from coming off. In cooperation with the skirt portion 13, the retainer 17 and the waterproof member 16 form an engagement space 15 for substantially permitting the entry of the receptacle 4 of the mating connector 2.

A pair of locking portion protection pieces 20 project or laterally or vertically stand preferably at the top and bottom portion of the rear end of the housing main body 19. These protection pieces 20 are located in front of locking portions 18 to be described later, and have a longer or greater vertical dimension (cross-sectional or frontal or transverse dimension) than the locking portions 18 to protect front parts of the locking portions 18. A pair of cover engaging portions 21 project on the left and right sides of each protection piece 20. The upper and lower cover engaging portions 21 are arranged substantially symmetrically, and engaging portions 22 of the wire protection cover 9 are brought or bringable into engagement therewith.

A pair of left and right lever mount portions 23 project from the skirt portion 13 of the housing main body 19. The lever mount portions 23 are substantially cylindrical, and the lever 7 is assembled so that the level mount portions 23 serve as a center of rotation or as pivotal center. At the leading end of each mount portion 23, a pair of stopper portions 23A project substantially along forward and backward directions. A pair of engagement slots 30 for permitting the insertion of the cam pins 5 of the mating connector 2 are formed in the left and right opening edges of the skirt portion 13.

Figure 6:
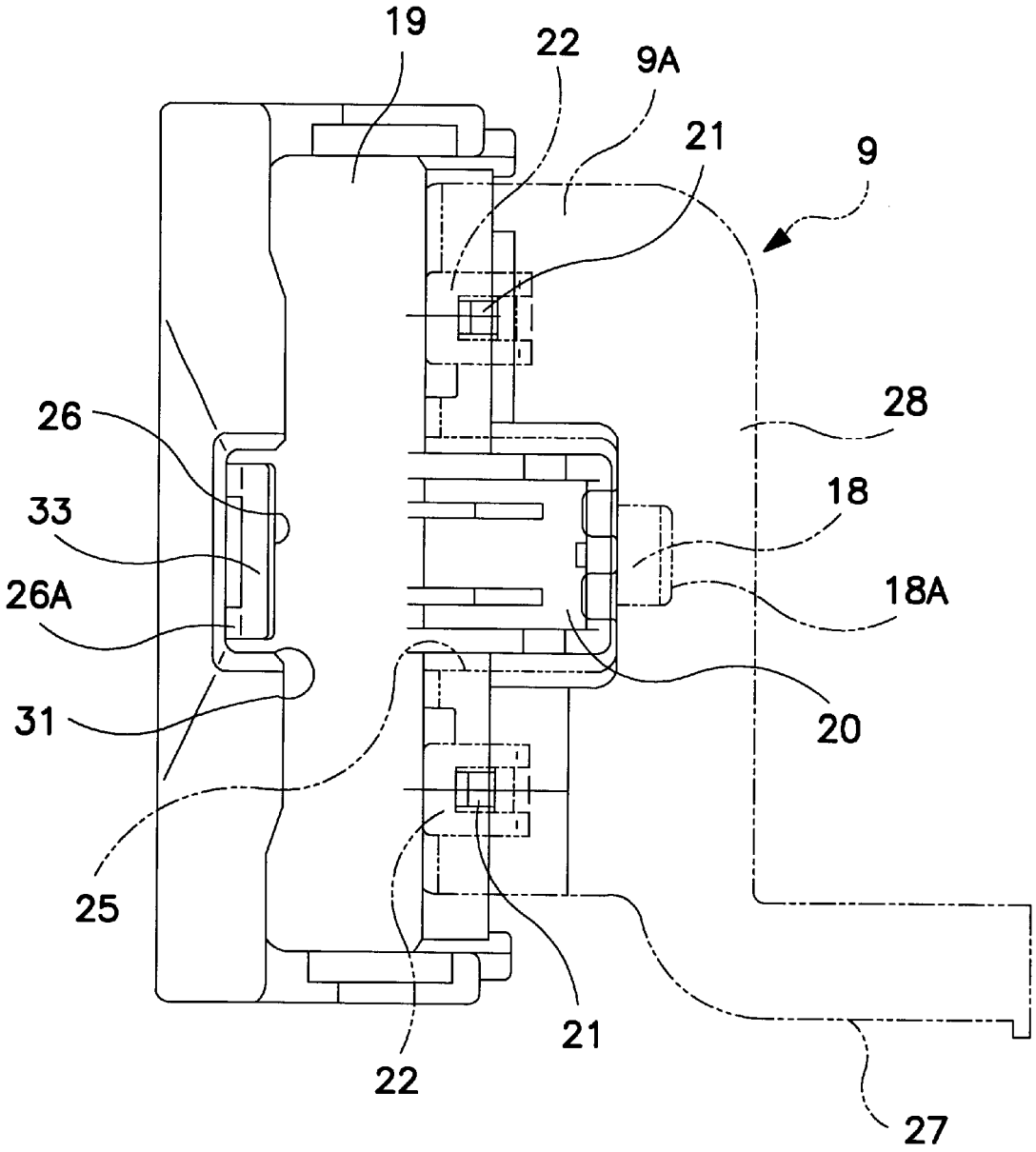
FIG. 6 is a plan view of the lever type connector.

Next, the wire protection cover 9 is described (see FIGS. 6 and 10). The wire protection cover 9 is adapted to substantially orient wires W connected with the female terminal fittings 10 in a specified direction while at least partially covering a rear part of the housing main body 19. A covering portion 9A for substantially covering the rear part of the housing main body 19 is provided at the front part of the wire protection cover 9. At the leading end of the covering portion 9A are provided preferably four engaging portions 22 in positions conforming or corresponding to the cover engaging portions 21 provided on the housing main body 19. The engaging portions 22 are slightly elastically deformable along vertical direction, and substantially prevent the wire protection cover 9 from being disengaged from the housing main body 19 by their engagement with the cover engaging portions 22. Recesses 25 are formed preferably in substantially middle portions of the upper and lower parts of the covering portion 9A in order to avoid the locking portion protection pieces 20 of the housing main body 19. The locking portions 18 project at the rear edges of the recesses 25 (FIG. 6). One each of the locking portions 18 is formed on the upper and lower parts of the protection cover 9, and the lever 7 is engageable with either of them. In other words, the lever 7 can be mounted on a more suitable side, considering how the lever type connector 1 is to be used. A backward projecting claw 18A is formed at the leading end of each locking portion 18. In an upper portion of the claw 18A is formed a guide surface 18B for facilitating the engagement with a lock claw 26 of the lever 7 to be described later. A rear end surface of the wire protection cover 9 is formed to bulge out, preferably backwardly, and this portion acts as an error disengagement preventing portion 28.

A wire retaining portion 27 is provided at a lateral or left side of the rear part of the wire protection cover 9 in FIG. 1. The wire retaining portion 27 has a substantially U-shaped cross section as a gutter does. The wires W substantially covered by the covering portion 9A are accommodated inside the wire retaining portion 27, and are bundled by taping or clamping or by a covering element to substantially extend in a specified direction. The wire protection cover 9 is mountable on either the top or the bottom of the housing main body 19.

The lever 7 is made e.g. of a synthetic resin to have a substantially U-shape, and is assembled to locate the lateral or left and right surfaces of the connector housing 8 inside the end portions of the U-shaped lever 7. The lever 7 is rotatable or pivotal between a connection start position (position shown in FIG. 1) where the insertion of the cam pins 5 of the mating connector 2 is permitted and a connection end position (position shown in FIG. 2) where the connection of the connector 1 and the mating connector 2 is completed.

A recess 31 is formed in a substantially middle portion of the lever 7. The lock claw 26 is provided inside the recess 31. The lock claw 26 is formed on a connecting piece for connecting the leading ends of a pair of elastic struts 26A extending obliquely backward from the outer surface of the recess 31. The elastic struts 26A are slightly vertically deformable, so that the lock claw 26 is elastically engageable with the locking portion 18 of the connector housing 8. The connecting piece for connecting the pair of elastic struts 26A is provided with an unlocking portion 33 in its portion more toward the leading end than the lock claw 26. The leading end of the unlocking portion 33 is so curved as to conform to a curved configuration of the outer surface of the error disengagement restricting portion 28 of the wire protection cover 9. Accordingly, the unlocking portion 33 and the error disengagement restricting portion 28 are near each other and leave only the minimum distance necessary to effect unlockingly when the lever 7 is rotated or pivoted to the connection end position where the lock claw 26 and the locking portion 18 engage each other. The lever 7 is formed with a connection piece 32 above the lock claw 26 for connecting an opening side of the recess 31. This connection piece 32 reinforces the strength of the recess 31 and prevents the lock claw 26 from being excessively elastically deformed upward.

Figure 5:
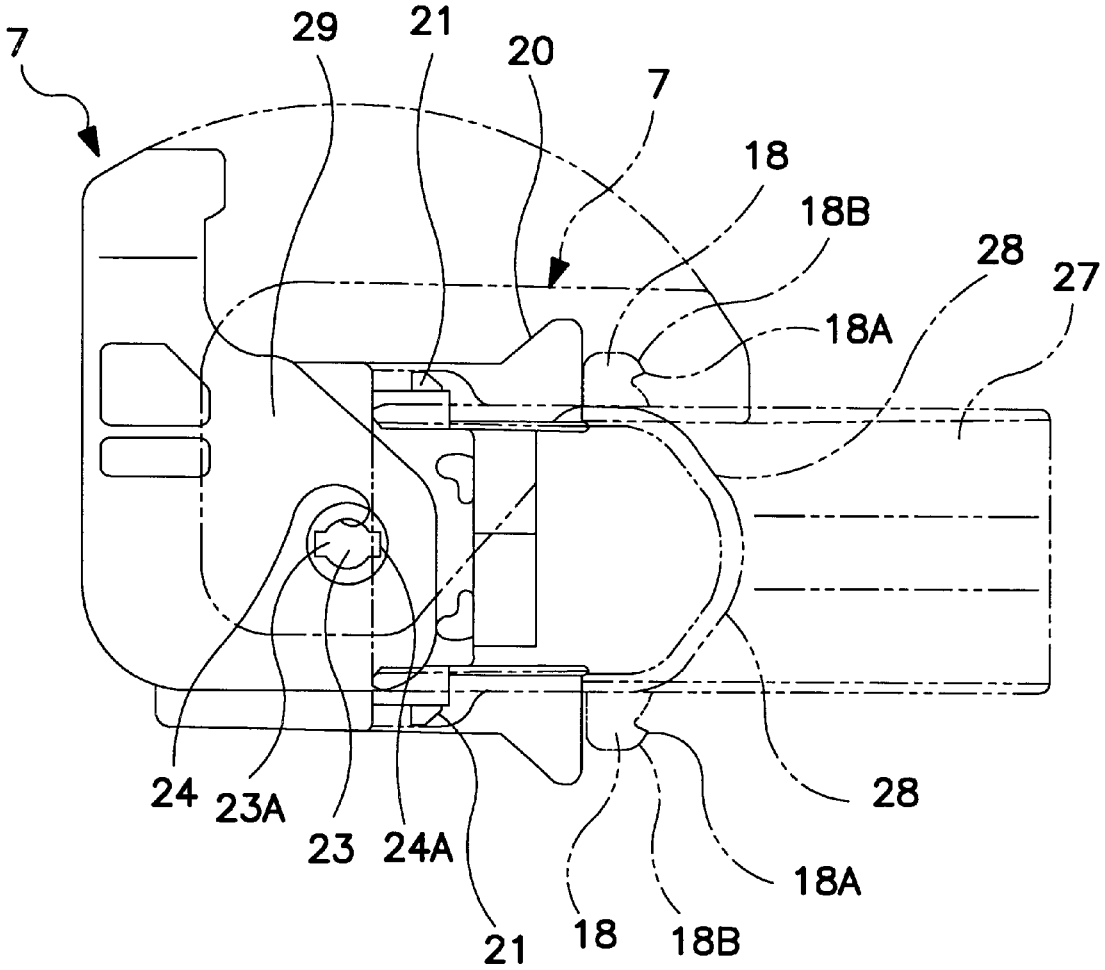
FIG. 5 is a side view of the lever type connector.

At the opposite or lateral sides of the lever 7 are provided a pair of mount legs 29. The mount legs 29 are slightly elastically deformable in such a direction as to increase a distance therebetween. The cam grooves 6 are formed in the inner sides of the mount legs 29 (sides facing the connector housing 8). The cam pins 5 are guided along the cam grooves as the lever 7 is rotated or pivoted, thereby bringing or forcing the connectors 1, 2 closer to a position where they are connected. The respective mount legs 29 are formed with mount holes 24 (FIG. 5). At the inner end of each mount hole 24 is formed a locking edge 24A projecting inward of the mount hole 24. The locking edges 24A are shaped to permit the passage of the lever mount portions 23 and hooks 23A of the housing main body. Specifically, the locking edges 24A have a diameter slightly larger than the outer diameter of the lever mount portions 23, and are formed with notches for permitting the passage of the hooks 23A. In other words, the lever 7 and the connector housing 8 can be assembled only in a position where the lever mount portions 23 and the mount holes 24 are aligned. A position where the locking edges 24A permit the passage of the hooks 23A is attainable when the lever 7 is in the connection start position.

Figure 11:
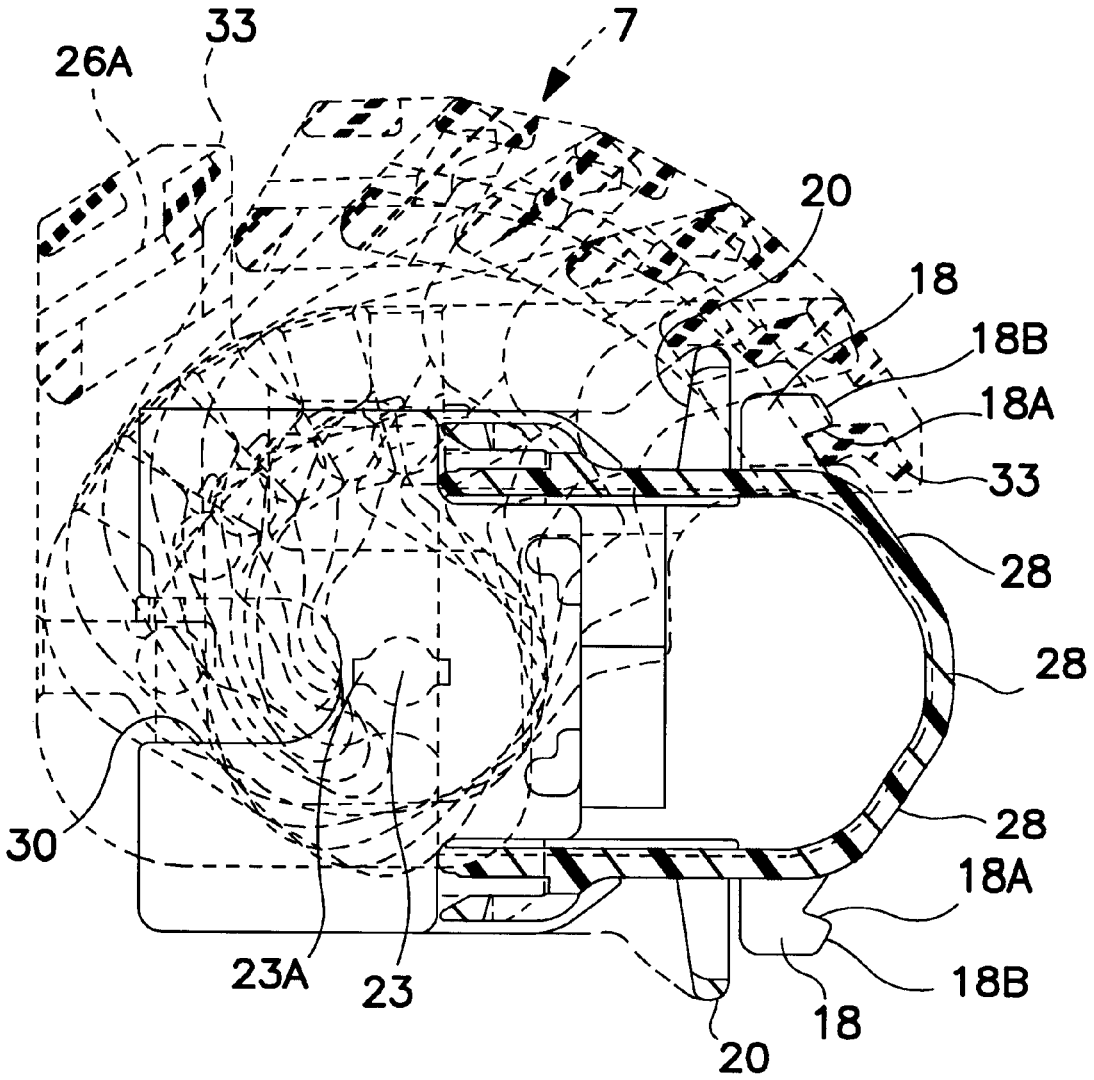
FIG. 11 is a side view of the engaged lever type connector and mating connector after the lever is rotated.
Figure 12:
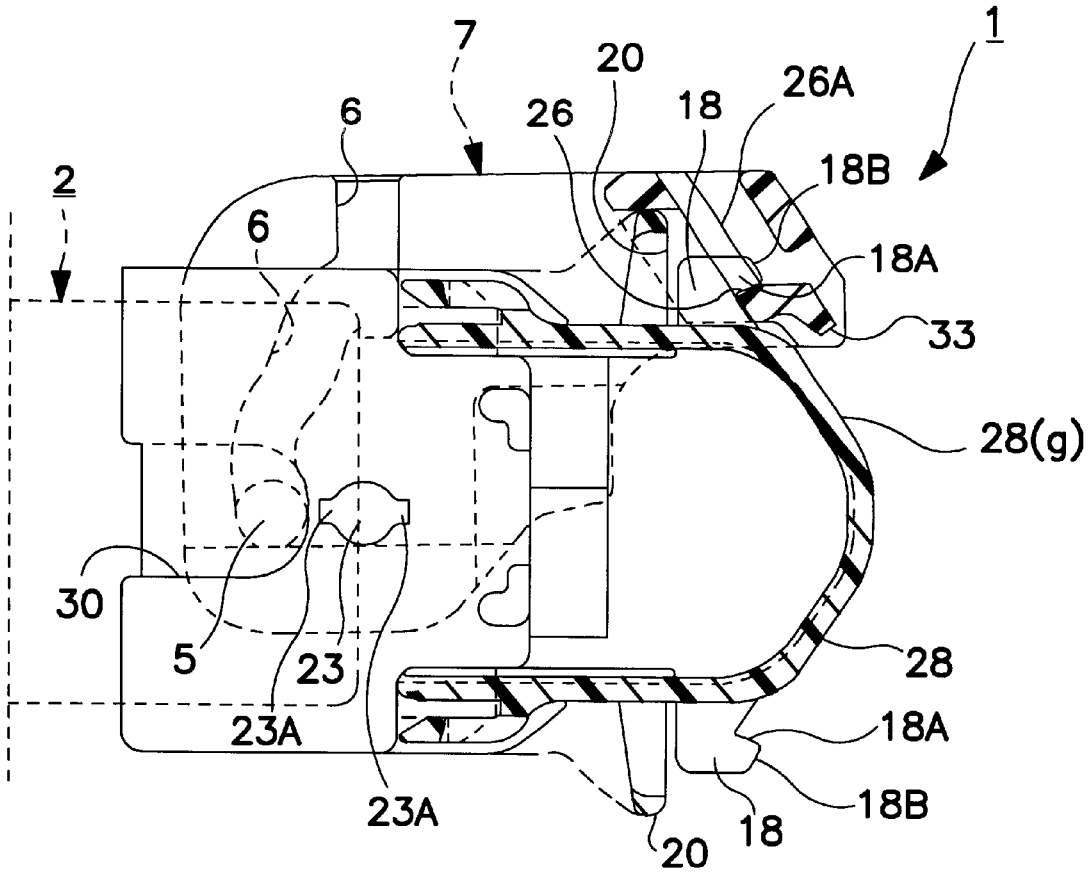
FIG. 12 is a side view showing the rotated lever in the lever type connector.
Figure 13:
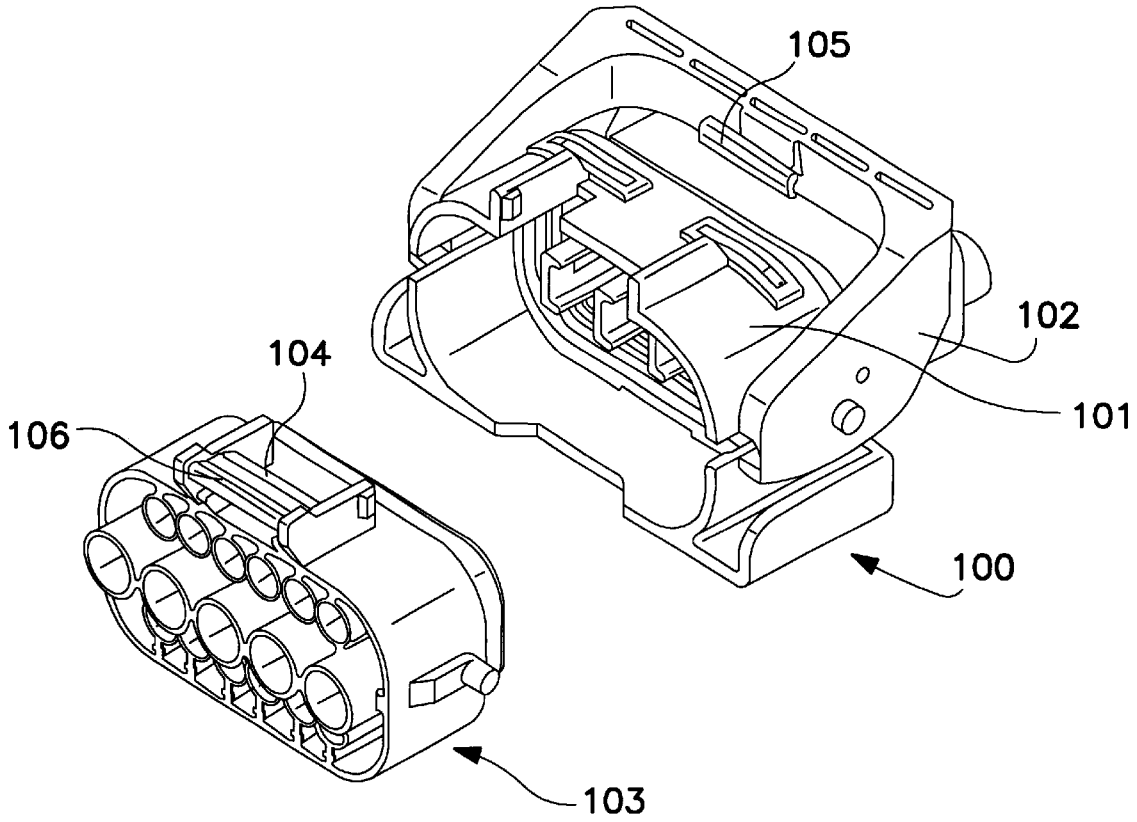
FIG. 13 PRIOR ART
FIG. 13 is a perspective view of a lever type connector and a mating connector before being engaged with each other in a prior art.
Figure 14:
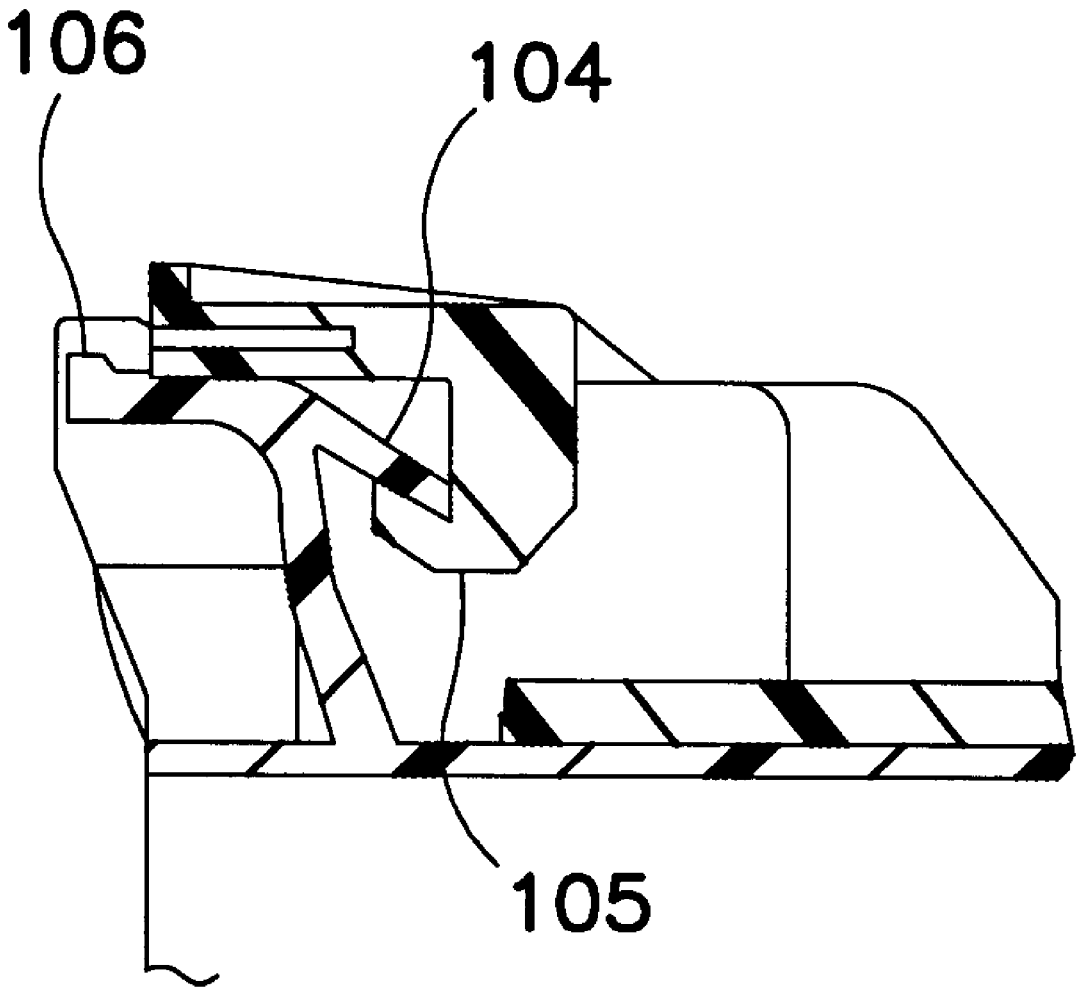
FIG. 14 PRIOR ART
FIG. 14 is a side view in section of the prior art when a locking portion and a lock claw are engaged.

Next, the action and effects of this embodiment constructed as above are described with reference to FIGS. 10 to 12.

FIG. 10 shows the lever type connector 1 when the lever 7 is substantially in the connection start position. In this state, the cam grooves 6 of the lever 7 are in alignment with or corresponding to the engagement slots 30 of the housing main body 19, thereby permitting the cam pins 5 of the mating connector 2 to be inserted. When the mating connector 2 is pushed to a specified position, the cam pins 5 are brought substantially into contact with the edges of the cam grooves 6. Subsequently, the connectors 1, 2 are guided in such directions as to be connected with each other by rotating or pivoting the lever 7 from the connection start position to the connection end position (see FIG. 11). When the lock claw 26 elastically moves over the claw 18A of the locking portion 18, the lock claw 26 and the locking portion 18 are engaged with each other, preventing the lever 7 from rotating in a reverse direction (or disengagement direction). At this time, the cam pins 5 reach preferably the very back of the engagement slots 30 by being pulled along the cam grooves 6, and the connection of the connectors 1, 2 is completed (see FIG. 12).

At this time, the error disengagement restricting portion 28 is located on a side of the unlocking portion 33 where unlocking is effected. Thus, even if an external force acts on the lever type connector 1, the error disengagement restricting portion 28 makes it difficult for the external force to act directly on the unlocking portion 33, preferably due to its outer shape substantially conforming that of the unlocking portion 33 (compare e.g. FIG. 12). Therefore, an inadvertent disengagement of the lever 7 and the locking portion 18 can be restricted.

Further, since the wire protection cover 9 preferably acts also as the error disengagement restricting portion 28, it is not necessary to separately provide the disengagement restricting portion 28.

Further, the connection piece 32 (FIGS: 4, 9) strengthens the lever 7 by connecting the opening side of the recess 31 and prevents the excessive deformation of the lock claw 26. Therefore, it is not necessary to provided two separate members: the connection piece 32 and a member for preventing the excessive deformation.

In addition, the leading end of the unlocking portion 33 is so curved as to conform to the curved configuration of the outer surface of the wire protection cover 9. This further improves a function of restricting the error disengagement of the lock claw 26 and the locking portion 18.

The housing main body 19 is provided with the locking portion protection pieces 20, thereby preventing an external force from directly acting on the locking portion from front. Therefore, an undesirable event where the lock claw 26 and the locking portion 18 are disengaged inadvertently can be more securely avoided.

The present invention is not limited to the foregoing embodiment. For example, embodiments below are also embraced by the technical scope of the present invention as defined in the claims.

The wire cover may be integrally formed with the housing main body.

The wire cover may not be provided. In such a case, the locking portion of the lever is provided on the housing main body.

The connection piece may not be provided.

The leading end of the unlocking portion may extend straight instead of being curved.

What is claimed is:

1. A connector, comprising:

a connector housing, a lever pivotably mounted on the connector housing for movement between first and second pivotal positions relative to the housing, the lever having at least one lock claw which is elastically engageable with at least one corresponding locking portion on the connector housing when the lever is in the second pivotal position relative to the connector housing, the lever further having an unlocking portion for disengaging the lock claw from the locking portion, wherein a wire protection cover is provided on the connector housing for protecting wires extending through the connector housing, the wire protection cover comprising an error disengagement restricting portion in proximity to a surface of the unlocking portion where unlocking is effected when the lock claw and the locking portion are engaged with each other to narrow a space necessary to effect unlocking, the wire protection cover having an outer surface with a curved configuration, the unlocking portion having a leading end curved to extend along the curved configuration of the outer surface of the wire protection cover while leaving a minimal interval therebetween necessary to effect unlocking when the lock claw and the locking portion are engaged with each other, such that the wire protection cover restricts erroneous disengagement of the lock claw from the locking portion.

2. A connector comprising:

a connector housing, a wire protection cover mounted to the connector housing for protecting wires extending through the connector housing, the wire protection cover having an outer surface with a selected curved configuration, a locking portion provided on the wire protection cover, a lever having opposed ends mounted on the connector housing such that said lever is pivotable movable from a first position where said lever is spaced from said wire protection cover to a second position where said lever is substantially adjacent the wire protection cover, a recess formed on the lever and substantially aligned with the locking portion of the wire protection cover when the lever is in the second position, an elastically deflectable lock claw formed on the lever and disposed in the recess, the lock claw being elastically engageable with the locking portion on the wire protection cover when the lever is in the second position, the lock claw having an unlocking portion for disengaging the lock claw from the locking portion for permitting movement of the lever toward the first position, a connection piece formed on the lever and extending across the recess for preventing excessive deformation of the lock claw in an unlocking direction, the unlocking portion having a leading end, wherein the leading end of the unlocking portion is curved to extend along the curved configuration of the outer surface of the wire protection cover while leaving a minimal interval therebetween necessary to effect unlocking when the lock claw and the locking portion are engaged with each other, such that the wire protection cover restricts erroneous disengagement of the lock claw from the locking portion.

3. A connector according to claim 2, wherein the locking portion is provided on the wire protection cover.

4. A connector according to claim 3, wherein the connector housing is provided with at least one locking portion protection portion for protecting a front part of the locking portion.

5. A connector according to claim 4, wherein the at least one locking portion protection portion is disposed in front of the locking portion and has a greater vertical dimension than the locking portion.

6. A connector according to claim 3, wherein the lever is pivotably mounted on lever mount portions on the connector housing, the lever mount portions comprising stopper portions for stopping rotation of the lever in a predetermined position.

7. A connector according to claim 3, wherein cam elements are provided on the lever for the interaction with mating cam elements provided on the mating connector for forcibly mating the connectors upon pivoting the lever.

8. A connector according to claim 3, wherein two locking portions are provided on opposite sides of the wire protection cover.

* * * * *